US008230559B2

(12) United States Patent
Fildan et al.

(10) Patent No.: US 8,230,559 B2
(45) Date of Patent: Jul. 31, 2012

(54) MAGNETIC BRASSIERE BACK CLOSURE

(75) Inventors: Gerhard Fildan, Vienna (DE); Karl Wanzenboeck, Leobersdorf (AT)

(73) Assignee: Fildan Accessories (HK) Ltd, Kwun Tong Kowloon (DE)

( * ) Notice: Subject to any disclaimer, the term of this patent is extended or adjusted under 35 U.S.C. 154(b) by 39 days.

(21) Appl. No.: 12/881,620

(22) Filed: Sep. 14, 2010

(65) Prior Publication Data

US 2012/0060330 A1 Mar. 15, 2012

(51) Int. Cl.
*A44B 11/25* (2006.01)

(52) U.S. Cl. ..... 24/303; 24/669

(58) Field of Classification Search ..... 24/303, 24/669, 114.05, 114.4, 578.1, 578.14, 591.1, 24/DIG. 43

See application file for complete search history.

(56) References Cited

U.S. PATENT DOCUMENTS

| | | | | | |
|---|---|---|---|---|---|
| 1,404,471 | A | * | 1/1922 | Nilsson | 24/669 |
| 2,102,223 | A | | 12/1937 | Roseman | |
| 2,122,138 | A | * | 6/1938 | Hansen | 24/667 |
| 2,809,411 | A | | 10/1957 | Moghadam | |
| 3,111,737 | A | | 11/1963 | Heil | |
| 3,376,616 | A | | 4/1968 | Kaczorowski | |
| 3,454,994 | A | * | 7/1969 | Andrews et al. | 24/669 |
| 3,512,226 | A | | 5/1970 | Carlile | |
| 4,399,595 | A | | 8/1983 | Yoon | |
| 4,805,272 | A | | 2/1989 | Yamaguchi | |
| 5,199,138 | A | * | 4/1993 | Morita | 24/303 |
| 5,253,394 | A | * | 10/1993 | Morita | 24/303 |
| 5,377,392 | A | * | 1/1995 | Morita | 24/303 |
| 5,664,298 | A | * | 9/1997 | Nessar-Ivanovic | 24/303 |
| 6,163,938 | A | | 12/2000 | Weber-Unger | |
| 6,557,232 | B2 | * | 5/2003 | Fildan et al. | 29/411 |
| 7,100,250 | B2 | * | 9/2006 | Fildan et al. | 24/591.1 |
| 7,435,154 | B2 | * | 10/2008 | Fildan et al. | 450/39 |
| 7,641,536 | B2 | * | 1/2010 | Fildan et al. | 450/72 |
| 2005/0251970 | A1 | * | 11/2005 | Fildan et al. | 24/114.05 |
| 2006/0230583 | A1 | * | 10/2006 | Chen | 24/114.4 |
| 2007/0113383 | A1 | * | 5/2007 | Grunberger et al. | 24/303 |

* cited by examiner

*Primary Examiner* — Robert J Sandy
*Assistant Examiner* — Abigail E Morrell
(74) *Attorney, Agent, or Firm* — Andrew Wilford

(57) ABSTRACT

A fastener for securing together two garment strap ends having confronting faces has at least male elements mounted on the face of one of the strap ends and respective female elements mounted on the face of the other strap end, generally complementary to the male element, and, with the faces touching or closely juxtaposed, slidably engageable in a direction parallel to the faces with the male elements to fasten the two strap ends together. Respective male and female magnets on the strap ends are oriented so as to hold the strap ends in a finder position with the faces engaging or closely juxtaposed with each other and the male and female elements spaced in the direction and disengaged from each other so that displacement of the strap ends apart in the direction from the finder position will engage and lock together the male and female elements.

8 Claims, 3 Drawing Sheets

MAGNETIC BRASSIERE BACK CLOSURE

FIELD OF THE INVENTION

The present invention relates to a garment fastener or closure. More particularly this invention concerns a closure for the back straps or wings of a brassiere.

BACKGROUND OF THE INVENTION

A typical brassiere comprises a pair of front cups that are connected together at their adjacent inner edges and respective side straps extending from outer edges of the cups back around the wearer and there forming so-called wings. Normally respective shoulder straps extend up from upper edges of the cups, over the wearer's shoulders, and down to the wings at the back where they are secured.

The ends of the wings overlap in the center of the wearer's back and are there joined together by a releasable closure or fastener that has an outer part provided on an inner face of the outer wing and a complementary inner part on an outer face of the inner wing, that is the wing bearing directly on the wearer's back. Such a closure is typically one or more hooks on the outer wing and one or more eyes on the inner wing, normally a row of eyes to allow some adjustability. Other arrangements of male and female parts are often also used.

The hardest part in donning such an undergarment is securing the two parts of the back fastener together. When this is done behind the back, the user cannot see it and the user's hands are inverted and arms are twisted back into a position that is uncomfortable and, in fact, impossible to assume for some. Since most brassieres have between two and five rows of hooks, these garments are much more difficult to close, so that normally the user fastens the wings of the undergarment together in the front and then wrestles the garment around to the back before it is actually donned, a much more complex procedure than simply pulling the front on and then closing the wings together behind the back.

U.S. Pat. No. 6,163,938 of Weber-Unger discloses a catch for a drop cup of a maternity brassiere. There the two closure parts are provided with respective permanent magnets exposed at the inner face of the outer wing and the outer face of the inner wing. The magnets are positioned such that the magnets attract each other and center on each other in a position with the male and female parts of the closure at least partially interengaged. The function of these magnets is to hold the closure in this partially closed position when there is no tension on the wings pulling them apart. To open or close the drop cup, the user must still carefully align and fit together the two closure parts, but this is a simple operation since it is in the front.

OBJECTS OF THE INVENTION

It is therefore an object of the present invention to provide an improved brassiere back closure.

Another object is the provision of such an improved brassiere back closure that overcomes the above-given disadvantages, in particular that is very easy to use.

SUMMARY OF THE INVENTION

A fastener for securing together two garment strap ends having confronting faces has according to the invention at least two male elements mounted on the face of one of the strap ends and respective female elements mounted on the face of the other strap end, generally complementary to the male element, and, with the faces touching or closely juxtaposed, slidably engageable in a direction parallel to the faces with the male element to fasten the two strap ends together. Respective male and female magnets on the strap ends are oriented so as to hold the strap ends in a finder position with the faces engaging or closely juxtaposed with each other and the male and female element spaced in the direction and disengaged from each other so that displacement of the strap ends apart in the direction from the finder position will engage and lock together the male and female elements.

With this system the woman donning the brassiere need merely roughly juxtapose the two strap ends, something easily done even behind the back. Once they are close to each other the magnets will take over and pull the two parts of the fastener together into a finder position, automatically aligning the fastener elements, even if there are as many as five such as used on some brassieres. With this invention in this finder position the male and female parts are not at all connected together, but are merely in a position from which they can be slid together to snap the fastener closed. The result is that the user can easily close the back fastener. To open it, the standard procedure is followed, simply sliding the two strap ends toward each other to disengage the parts.

According to the invention the magnets are polarized substantially perpendicular to the direction. They are cylindrical and the magnet of the female part is of substantially larger diameter than that of the male part. In addition one of the magnets is fixedly imbedded in the respective part, while the other is received with some plan in its part, which to this end is made somewhat annular to form a central hole in which the magnet is loosely received. This loosely received magnet, however, is itself sandwiched between front and back layers of the respective strap end so that it, like the other magnet, is never directly outwardly exposed.

The female part in accordance with the invention is generally butterfly-shaped and open in the direction and the male part is a headed peg fittable between wings of the female part. It could also be a simple eye with the male part being a hook. With the former arrangement, the magnet of the male part is centered on an axis of the peg.

The strap ends according to the invention each have a pair of layers between which the respective element is at least partially sandwiched. Each element is part of a one-piece plastic body at least partially sandwiched between the respective layers.

Each strap end according to the invention has two or even more of the respective elements each with a respective such magnet.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
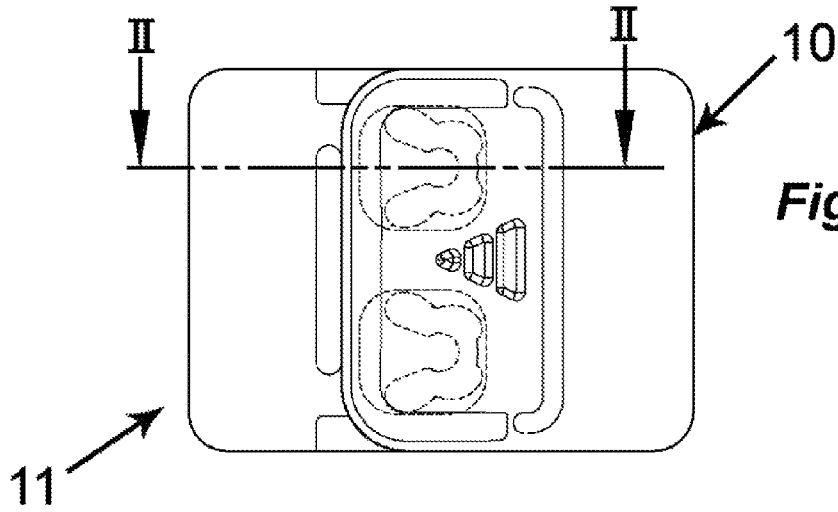
FIG. 1 is a rear view of the back closure according to the invention.
Figure 2:
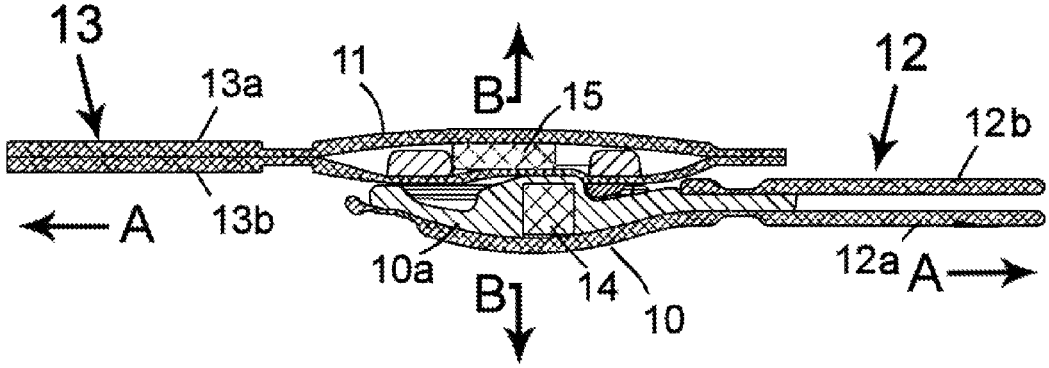
FIGS. 2 and 3 are sections taken along line II of FIG. 1 showing the enclosure mounted on two wings in the fully closed and finder positions, respectively.
Figure 3:
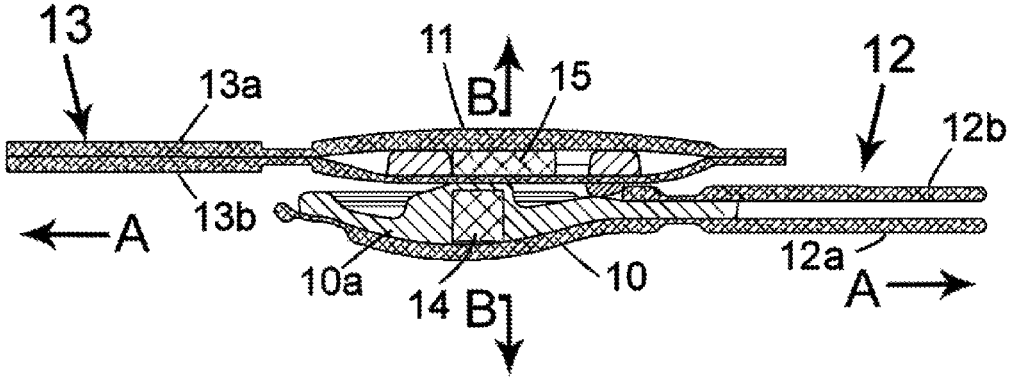
Figure 4:
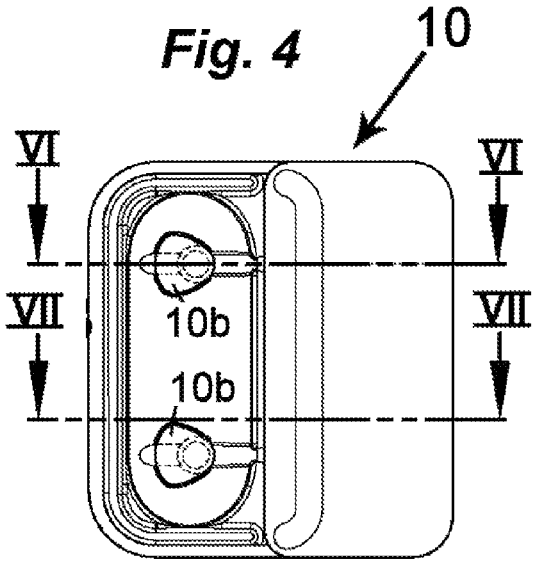
FIGS. 4 and 5 are front and back views of the male part of the closure.
Figure 5:
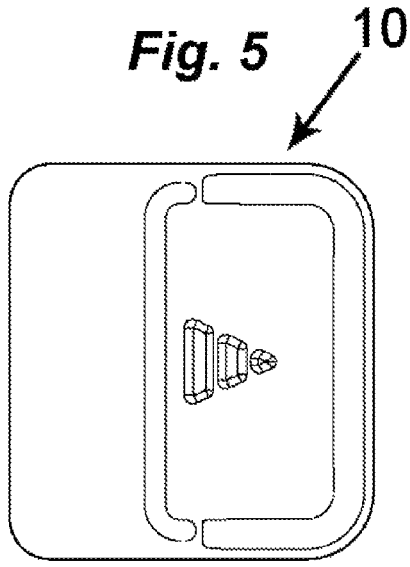
Figure 6:
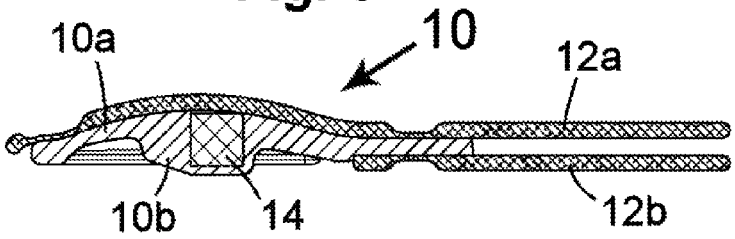
FIGS. 6 and 7 are sections taken along respective lines VI-VI and VII-VII of FIG. 4.
Figure 7:
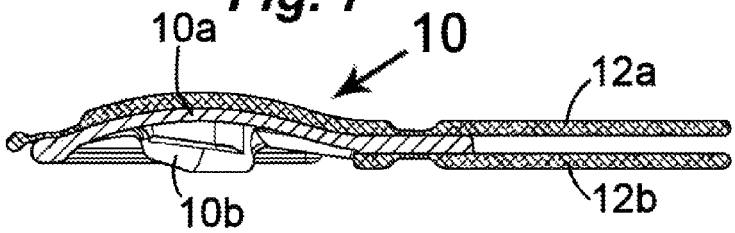

As seen in FIGS. 1-3 a closure according to the invention comprises a rear male part 10 and a front female part 11 that are secured to the inner ends of wings 12 and 13 of a brassiere of standard construction. The part 10 is largely sandwiched between back and front layers 12*a* and 12*b* of the wing 12, which layers are normally made of a flexible textile. Similarly the part 11 is largely enclosed and sandwiched between front and back layers 13*a* and 13*b* of the wing 13, also made of a flexible textile with the front layer 13*a* lying directly against the back of the wearer.

As also shown in FIGS. 4-7, the rear male part 10 has a pair of transversely spaced and identical molded-plastic bodies 10*a* whose rear faces are bonded to the back layer 12*a* of the wing 12 and that are each formed on their front faces with a headed peg element 10*b* that projects through and is not covered by the layer 12*b*. This structure is of generally known design, but here according to the invention each body 10*a* is provided with a small-diameter cylindrical permanent magnet 14 polarized on an axis that is back to front, parallel to the view plane in FIG. 6 and perpendicular to that of FIGS. 4 and 5. These magnets 14 are each wholly imbedded in and surrounded by the plastic of the respective body 10*a*.

Figure 8:
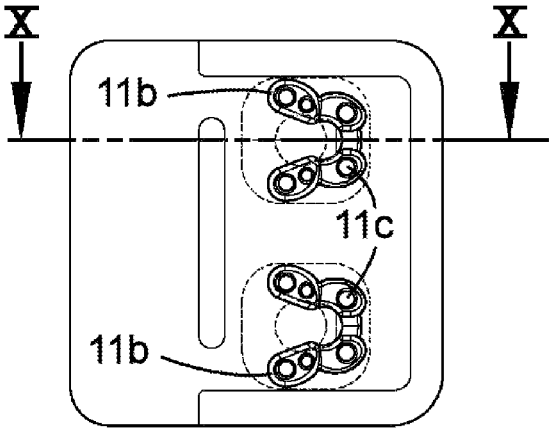
FIGS. 8 and 9 are back and front views of the female part of the closure.
Figure 9:
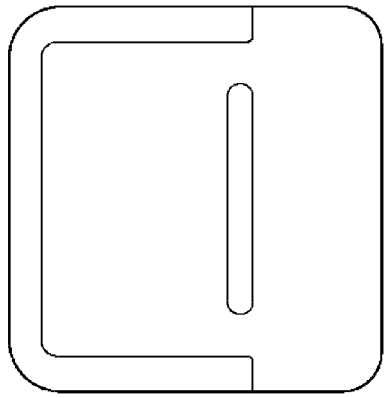
Figure 10:
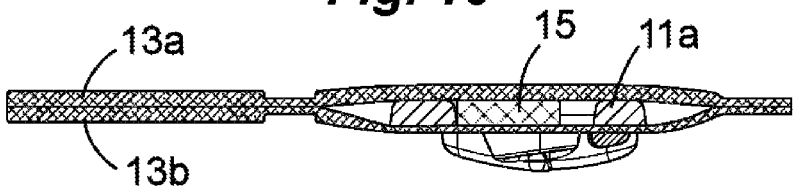
FIG. 10 is a section taken along line X-X of FIG. 8.

FIGS. 8-10 show that the female part 11 has two transversely spaced molded plastic bodies 11*a* that are wholly sandwiched between the layers 13*a* and 13*b* and to each of which a plastic butterfly-shaped element 11*b* is secured through the layer 13*b* by plastic rivets 11*c*, so that the elements 11*b* lie wholly rearward of the back layer 13*b* but the entire front of each part 11 is kept out of direct contact with the wearer by the front layer 13*a*. Each headed peg element 10*b* and the respective element 11*b* can fit complementary together with the head of the peg 10*b* captured forward of the element 11*b*, in a manner well known in the art. According to the invention, a cylindrical magnet 15 of a diameter greater than that of the magnet 14 is surrounded by each body 11*a* and wholly contained between the layers 13*a* and 13*b*. These magnets 15 are also polarized along a front-to-back axis parallel to that of the magnets 14 and in the same direction so that the north pole of one of each of the magnets 14 and 15 can directly confront and attract the south pole of the other respective magnets 14 or 15.

According to the invention the magnets 14 and 15, which can be nickel- or gold-plated are kept out of direct contact with the wearer. The front female magnet 15 is here 4 mm in diameter and 1 mm thick, shaped like a coin. The rear male magnet 14 is 2 mm thick and 2 mm in diameter. This construction is important because as described below it establishes a so-called fitter position that does not require care to establish. If the magnets are approached to each other, they will move together axially as soon as they are roughly juxtaposed. Since the rear magnet 14 is smaller than the front magnet, it will settle into any of a number of slightly offset positions so long as the center axis of the rear magnet 14 traverses the front magnet 15.

Figure 11A:
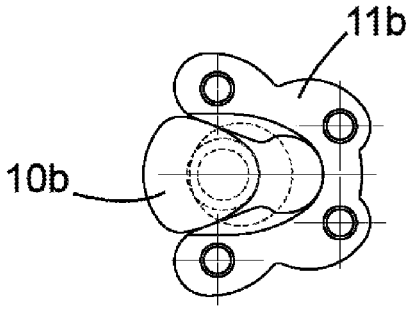
FIGS. 11A and 11B are schematic views illustrating how the instant invention functions.
Figure 11B:
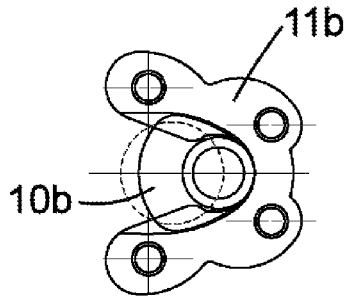

Thus in accordance with this invention the two magnets 14 and 15 are oriented in the respective parts 10 and 11 and dimensioned such that, if they are roughly juxtaposed, they will pull the two parts 10 and 11 together into a finder position shown in FIGS. 2 and 11A in which the front layer 12*b* of the one wing 12 lies on the back layer 13*b* of the other wing 13, but with the two elements 10*b* and 11*b* not latched together. In this finder position the two parts 10 and 11 can move freely away from each other as indicated by arrows B, in other words the fastener is still open. From this position, however, pulling the wings 12 and 13 apart as indicated by arrows A will move the parts 10 and 11 together to the position of FIGS. 2 and 11B to lock the part 11*b* under the part 10*b* and thereby close the fastener. The two elements 10*b* and 11*b* fit together in this closed position in a moderately snug friction fit that is strong enough to prevent the magnets from pulling the two parts 10 and 11 back into the unlatched finder position.

It is therefore possible for the woman donning the brassiere to generally juxtapose the two ends of the wings 12 and 13. Because of the relative sizes of the two magnets 14 and 15 the fitter position is not a single exact position, but is attained in any of a number of slightly offset positions, making use of this fastener very easy. As soon as the back and front parts 10 and 11 get close to each other, their magnets 14 and 15 will pull them together into the finder position, and then a spreading of the straps will engage the two fastener parts 10 and 11 together, effectively closing the fastener.

We claim:

1. A fastener for securing together two garment strap ends having confronting faces, the fastener comprising:

a male element mountable on the face of one of the strap ends and formed as a part of a respective one-piece body;

a female element mountable on the face of the other strap end and formed as a part of a respective one-piece body, generally complementary to the male element, and, with the faces touching or closely juxtaposed, slidably engageable in a direction parallel to the faces with the male element to fasten the two strap ends together; and respective male and female magnets on the strap ends oriented adjacent the respective male and female elements so as to hold the strap ends in a finder position with the faces engaging or closely juxtaposed with each other and the male and female elements spaced in the direction and disengaged from each other, whereby displacement of the strap ends apart in the direction from the finder position will engage and lock together the male and female elements, the magnets of one of the elements being fixedly imbedded in the respective body, the body of the other of the elements being formed with a large hole in which the respective magnet is received loosely.

2. The fastener defined in claim 1, wherein the magnets are polarized substantially perpendicular to the direction.

3. The fastener defined in claim 1, wherein the female element is generally butterfly-shaped and open in the direction and the male element is a headed peg fittable between wings of the female element.

4. The fastener defined in claim 3, wherein the magnet of the male element is centered on an axis of the peg.

5. The fastener defined in claim 1 wherein the strap ends each have a pair of layers between which the respective body is at least partially sandwiched and of which at least one forms the face on which the respective element is mounted.

6. The fastener defined in claim 5 wherein the one-piece plastic body of each element is at least partially sandwiched between the respective layers.

7. The fastener defined in claim 1 wherein the magnet of the other element is substantially larger than the magnet of the one element.

8. The fastener defined in claim 7 wherein the magnets are cylindrical and polarized on axes generally perpendicular to the respective faces.

* * * * *